US006276440B1

(12) United States Patent
Kaga et al.

(10) Patent No.: US 6,276,440 B1
(45) Date of Patent: Aug. 21, 2001

(54) DEVICE FOR CONTROLLING DIFFUSED AIR

(75) Inventors: Kunihiko Kaga; Tomoko Suzuki; Satoru Kotoh; Katsuhisa Ootsuta; Takayuki Yoshida; Eriko Kumekawa; Sakuo Sugawara; Tatsuo Seki, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/481,536

(22) Filed: Jan. 12, 2000

Related U.S. Application Data

(62) Division of application No. 09/028,291, filed on Feb. 24, 1998, now Pat. No. 6,083,101.

(30) Foreign Application Priority Data

Aug. 30, 1996 (JP) ..... 8-230546

(51) Int. Cl.[7] ..... F28F 27/00

(52) U.S. Cl. ..... 165/96; 165/122; 454/309; 454/313

(58) Field of Search ..... 165/96, 122; 454/309, 454/313, 319, 320, 321

(56) References Cited

U.S. PATENT DOCUMENTS

| | | | | |
|---|---|---|---|---|
| Re. 20,397 | * | 6/1937 | Germonprez | 454/309 |
| 2,051,929 | * | 8/1936 | Young et al. | 454/319 |
| 2,140,993 | * | 12/1938 | Germonprez | 454/309 |
| 2,145,073 | * | 1/1939 | Drake | 454/309 X |
| 2,195,411 | * | 4/1940 | Germonprez | 454/309 |
| 2,195,412 | * | 4/1940 | Germonprez | 454/309 |
| 2,210,023 | * | 8/1940 | Candor | 454/309 |
| 2,813,475 | * | 11/1957 | Koch | 454/309 |
| 2,959,116 | * | 11/1960 | O'Day et al. | 454/309 |
| 6,083,101 | * | 7/2000 | Kaga et al. | 454/309 |

FOREIGN PATENT DOCUMENTS

| | | | | |
|---|---|---|---|---|
| 57-105640 | * | 7/1982 | (JP) | 454/313 |
| 60-101442 | * | 6/1985 | (JP) | 454/313 |
| 61-141655 | | 9/1986 | (JP) . | |
| 61-145248 | | 9/1986 | (JP) . | |
| 2-28039 | | 2/1990 | (JP) . | |
| 4-335945 | * | 11/1992 | (JP) | 454/313 |
| 5-19845 | | 3/1993 | (JP) . | |
| 5-187959 | | 7/1993 | (JP) . | |
| 288605 | * | 10/1994 | (JP) | 454/313 |
| 6-288605 | * | 10/1994 | (JP) | 454/313 |

* cited by examiner

*Primary Examiner*—Leonard Leo
(74) *Attorney, Agent, or Firm*—Oblon, Spivak, McClelland, Maier & Neustadt, P.C.

(57) ABSTRACT

An air outlet has a plurality of vertical vortex generating structures 21 in a triangular shape arranged so as to be oriented at an angle θ with respect to diffused air.

2 Claims, 13 Drawing Sheets

DEVICE FOR CONTROLLING DIFFUSED AIR

This application is a division application Ser. No. 09/028,291 filed on Feb. 24, 1998 now U.S. Pat. No. 6,083,101.

BACKGROUND OF THE INVENTION

1. Field of the Invention

The present invention relates to a device for controlling diffused air for an air conditioning and heating device and so on.

2. Discussion of Background

The device for controlling diffused air in a conventional air conditioning and heating device will be explained referring to FIG. 16. In FIG. 16, there is shown a vertical cross-sectional view of the indoor unit of the air conditioning and heating device disclosed in JP-B-830600. In the air conditioning and heating device, the indoor unit is constituted by a heat exchanger 1, a fan 2, an air outlet 10 for diffusing conditioned air 11, a first flap 12 for changing a diffusing angle of the conditioned air 11 in a vertical direction, and a second flap for changing a diffusing angle of the conditioned air 11 in a horizontal direction. In order to obtain required heating capacity, there are proposed a measure to ensure large air volume and a measure to heat diffused air to a high temperature (raise a refrigerant condensing temperature). In general, the latter measure is adopted to raise the temperature of diffused air since it is difficult to obtain sufficient air volume to heat a room having a large space. High temperature of diffused air is likely to rise because of increased buoyancy, creating a problem in that high temperature of air stays near to a ceiling of a room to prevent the temperature near to a floor from rising to a sufficient level and a person in the room feels uncomfortable. In a conventional way wherein high temperature of diffused air can overcome buoyancy to reach the floor so as to establish a comfortable room environment with a temperature difference minimized between the ceiling and the floor, a downward component of the velocity of the diffused air in a vertical direction has been raised to cope with the problem. For example, the case of FIG. 16 has adopted a measure to raise a downward component of the velocity of the diffused air by directing the first flap 12 substantially downwardly so that an air path defined by the first flap 12 and a lower wall surface of the air outlet 10 is convergent toward to a downstream direction.

The conventional measure stated earlier requires that a pressure generated by the fan 2 be large in order to obtain required diffused air velocity, creating a problem in that it is necessary to increase fan power. In particular, a room having a large space requires vigorous conditions for ensuring required downward component of the velocity because of increased buoyancy caused by an increase in the temperature of the diffused air in heating. On the other hand, the diffusing angle for diffused air is required to be substantially horizontal in order that heated air can reach to a position far from the air conditioning and heating device. However, conventional way has created-a problem in that it is impossible to ensure required velocity in other modes than the one for diffusing conditioned air downwardly because the angle of the air outlet 10 is fixed.

SUMMARY OF THE INVENTION

It is an object of the present invention to dissolve these problems, and to provide a measure to establish a comfortable room environment by allowing conditioned air to reach a floor without lowering heating capacity and increasing fan power in heating.

According to a first aspect of the present invention, there is provided a device for controlling diffused air comprising an air outlet structure connected to a terminal end of an air path so as to diffuse air into ambient air; a flap arranged in the air outlet structure for deflecting a diffusing direction of the diffused air; and ambient air drawing and mixing means for drawing the ambient air into the diffused air and mixing the ambient air with the flow air.

According to a second aspect of the present invention, the ambient air drawing and mixing means is arranged in the air outlet structure so as to project into the diffused air and is constituted by at least one three-dimensional structure for generating a vertical vortex in the diffused air.

According to a third aspect of the present invention, the three-dimensional structure is constituted by a triangular or rectangular plate, and the plate has a contacting side contacting the air outlet structure so that the contacting side is set at a certain angle with respect to the flow direction.

According to a fourth aspect of the present invention, the three-dimensional structure is arranged perpendicularly to a surface of the air outlet structure which the three-dimensional structure contacts.

According to a fifth aspect of the present invention, the three-dimensional structure has the contacting side arranged so as to be set at substantially an angle of 10°–30° with respect to the flow direction.

According to a sixth aspect of the present invention, the three-dimensional structure has a projection edge extended from a surface of the air outlet structure which the three-dimensional structure contacts, and the projection edge has a projection height h of substantially ⅕–2 times a length L of the contacting side.

According to a seventh aspect of the present invention, a plural number of the three-dimensional structures are arranged at positions corresponding to vertical sections of the diffused air, and a distance S between adjacent three-dimensional structures is substantially 5–10 times a length L of the contacting side.

According to an eighth aspect of the present invention, the three-dimensional structure has a projection edge extended from a surface of the air outlet structure which the three-dimensional structure contacts, and the projection edge has a projection height h of substantially 1/20–⅓ times a width W of the air outlet structure in a direction where the projection edge extends.

According to a ninth aspect of the present invention, a plural number of the three-dimensional structures are arranged at positions corresponding to vertical sections of the diffused air, and adjacent three-dimensional structures are arranged convergently so as to be plane-symmetrical each other with respect to a plane parallel to the flow direction.

According to a tenth aspect of the present invention, the three-dimensional structure has a bottom surface which contacts the air outlet structure, and the three-dimensional structure is formed in one of a circular cone shape, a semicircular cone shape and an elliptical cone shape.

According to an eleventh aspect of the present invention, the three-dimensional structure has an apex located on a downstream side of the diffused air with respect to an axis extending perpendicularly to a center of the bottom surface.

According to a twelfth aspect of the present invention, the three-dimensional structure has a bottom surface which contacts the air outlet structure, and the three-dimensional structure is formed in a pyramid shape.

According to a thirteenth aspect of the present invention, the three-dimensional structure is formed in a triangular pyramid shape, a triangle as a bottom surface of the triangular pyramid shape has a side located substantially perpendicularly to the flow direction, and the side is located on one of an upstream side and a downstream side of the diffused air with respect to the other sides of the triangle.

According to a fourteenth aspect of the present invention, the side of the triangle is located so that a point of intersection between a perpendicular extending from an apex of the triangular pyramid shape to the air outlet structure and the air outlet structure is located on a downstream side of the diffused air with respect to the side of the triangle.

According to a fifteenth aspect of the present invention, the flap is arranged in the air outlet structure so as to guide the diffused air in a horizontal direction, and the three-dimensional structure is arranged on at least one of an upper leading edge and a lower leading edge of the flap on a downstream side of the diffused air.

According to a sixteenth aspect of the present invention, the flap is arranged in the air outlet structure so as to guide the diffused air in a vertical direction, and the three-dimensional structure is arranged on the flap.

According to a seventeenth aspect of the present invention, the three-dimensional structure is arranged so as to be prevented from interfering with the diffused air when the diffused air has a temperature not higher than the ambient air.

According to an eighteen aspect of the present invention, the flap is arranged in the air outlet structure so as to guide the diffused air in a horizontal direction, and the ambient air drawing and mixing means is constituted by the flap which has an end thereof on a downstream side of the diffused air extended longer than an end thereof on an upstream side of the diffused air for generating a vertical vortex in the diffused air, both ends of the flap being located perpendicularly to the flow direction.

According to a nineteenth aspect of the present invention, the flap is arranged in the air outlet structure so as to guide the diffused air in a horizontal direction, and the ambient air drawing and mixing means is arranged on the air outlet and is constituted by at least two guide wings which are connected to an edge of the flap and are turnable in a horizontal direction independently of each other, the edge being located on a downstream side of the flap in the flow direction, and the vertical vertex being generated in the diffused air by the guide wings.

In accordance with the first aspect, the diffused air mixes with ambient air just after the diffused has been blown out. The temperature difference between the diffused air and the ambient air can be reduced to provide a comfortable environment with a minimized temperature difference. Particularly, in heating, the temperature of the diffused air can be lowered since the diffused air mixes with a lower temperature of ambient air just after the diffused air has been blown out. An adverse effect given by buoyancy can be reduced to send warm air to a floor without increasing an outlet velocity to such a degree that fan power becomes excessive and without lowering heating capacity, thereby equally heating a room to improve comfort therein significantly.

In accordance with the second aspect, the vertical vortex can cause the diffused air to mix with ambient air just after having been blown out, providing a comfortable environment with a temperature difference minimized. Particularly, in heating, warm air can be sent to a floor without lowering heating capacity and without increasing fan power, thereby equally heating a room to improve comfort in the room significantly.

In accordance with the third aspect, the vertical vortex can be generated by adopting such a simple shape.

In accordance with the fourth aspect, the vertical vortex can be generated in a stronger way to increase a mixing amount of the diffused air and the ambient air, offering an advantage in that the diffused air can be prevented from rising in a more effective way particularly in heating.

In accordance with the fifth aspect, a mixing amount of the diffused air and the ambient air can be increased. A degree of drop in the temperature of the diffused air which is caused by mixing the diffused air with a lower temperature of ambient air is great particularly in heating. It is possible to offer advantages in that the diffused air can be effectively prevented from rising, and that pressure loss is reduced and an increase in fan power is minimized.

In accordance with the sixth aspect, a mixing amount of the diffused air and the ambient air can be increased. A degree of drop in the temperature of the diffused air which is caused by mixing the diffused air with a lower temperature of ambient air is great particularly in heating. It is possible to offer advantages in that the diffused air can be effectively prevented from rising, and that pressure loss is reduced and an increase in fan power is minimized.

In accordance with the seventh aspect, a mixing amount of the diffused air and the ambient air can be increased. A degree of drop in the temperature of the diffused air which is caused by mixing the diffused air with a lower temperature of ambient air is great particularly in heating. It is possible to offer advantages in that the diffused air can be effectively prevented from rising, and that pressure loss can be reduced and an increase in fan power is minimized.

In accordance with the eighth aspect, a mixing amount of the diffused air and the ambient air can be increased. A degree of drop in the temperature of the diffused air which is caused by mixing the diffused air with a lower temperature of ambient air is great particularly in heating. It is possible to offer advantages in that the diffused air can be effectively prevented from rising, and that pressure loss can be reduced and an increase in fan power can be minimized.

In accordance with the ninth aspect, a vertical vortex is formed in a vortical direction opposite to that of an adjacent vertical vortex, offering an advantage in that the diffused air can be provided in a stable way without positioning the centers of respective vortexes in a single direction.

In accordance with the tenth aspect, the vertical vortex can be generated by adopting such a simple shape. In addition, there is offered an advantage in that structural strength is increased in comparison with a plate-shaped of vertical vortex generating structure.

In accordance with the eleventh aspect, the strength of the generated vertical vortex is increased to raise the mixing amount of the diffused air and the ambient air. Particularly, in heating, the temperature of the diffused air can be effectively lowered since the amount that the diffused air mixes with a lower temperature of ambient air just after having been blown out becomes great. It is easy to send the warm air to a floor.

In accordance with the twelfth aspect, the vertical vortex can be generated by adopting such a simple shape, and structural strength is increased as in the first aspect.

In accordance with the thirteenth aspect, the vertical vortex can be generated by adopting such a simple shape, and structural strength can be increased as in the twelfth aspect. In addition, the outlet velocity is unlikely to lower because the triangular pyramid shape can reduce flow resistance in comparison with the circular cone shape, the semicircular cone shape and the oblique cone shape.

In accordance with the fourteenth aspect, the vertical vortex can be generated by adopting such a simple shape, and structural strength can be enhanced as in the twelfth aspect. The strength of the generated vertical vortex can be increased. In heating, the mixing amount of the diffused air and a lower temperature of ambient air can be increased, offering an advantage in that the diffused air can be effectively prevented from rising.

In accordance with the fifteenth aspect, even if the diffused air changes in the horizontal direction, the angle of attack of the diffused air with the vertical vortex generating structure can be appropriately maintained, offering an advantage in that the vertical vortex can be provided in a stable and strong way.

In accordance with the sixteenth aspect, the diffused air mixes with the ambient air just after having been blown out, providing a comfortable environment with a temperature difference minimized as in the second aspect. The diffused air can be provided by the flap so as to have a convergent form toward a downstream direction. The diffused air can be provided so as to have high initial velocity and long reach, facilitating a reach to a floor.

In accordance with the seventeenth aspect, the diffused air is prevented from rising only in heating. the diffused air can be provided in a stable way with turbulence minimized in cooling and ventilating.

In accordance with the eighteenth aspect, the vertical vortex is generated at each of an upper and a lower edge of the flap, fostering the mixture between the diffused air and the ambient air.

In accordance with the nineteenth aspect, a state wherein the transfer velocity inherent to the vertical vortex on an upper portion of the flap is different from the transfer velocity inherent to the vertical vortex on a lower portion of the flap can be easily realized, allowing the angle of the diffused air to change at a position far from the device.

DESCRIPTION OF THE PREFERRED EMBODIMENTS

Embodiment 1

Figure 1:
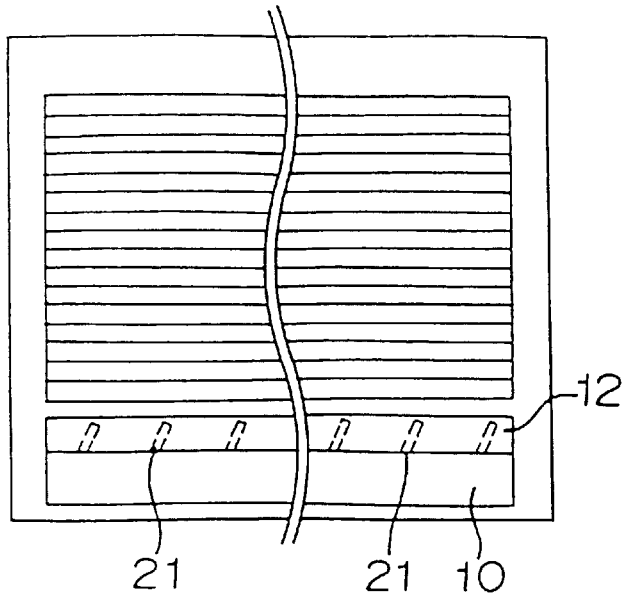
FIGS. 1(*a*) and (*b*) are a front view and a vertical cross-sectional view showing the device for controlling diffused air according to a first embodiment of the present invention.
Figure 1:
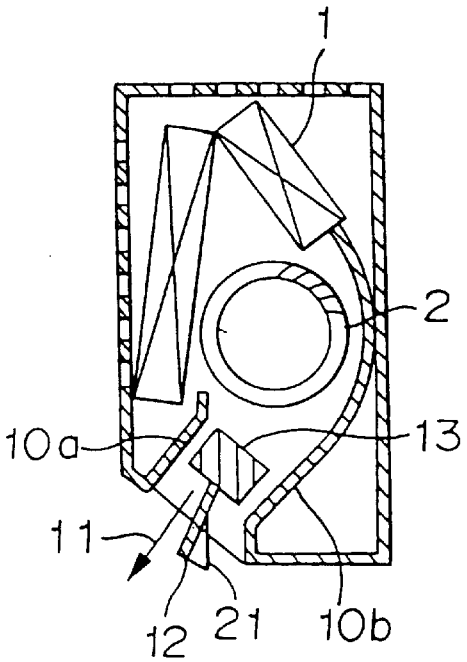
Figure 2:
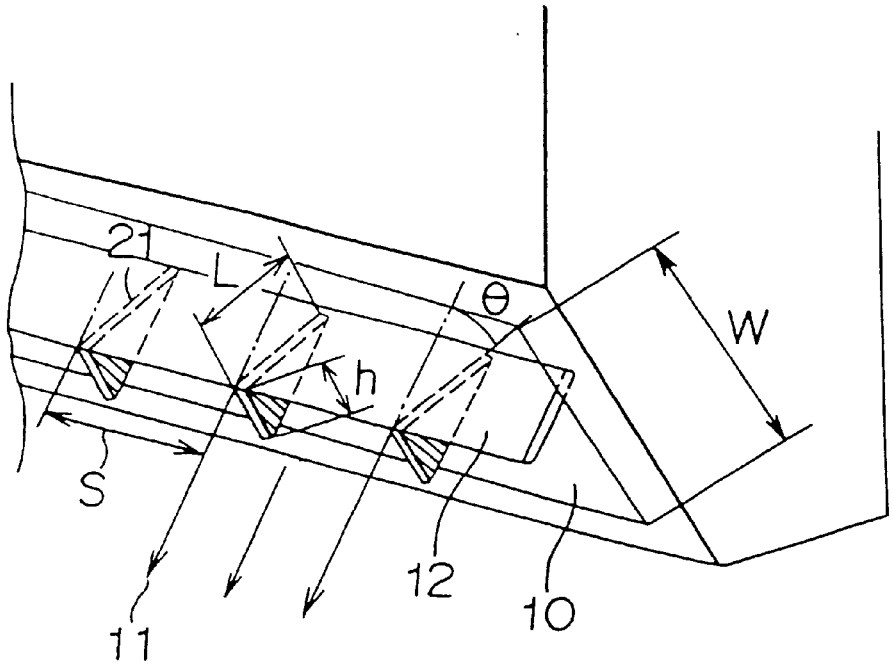
FIGS. 2(*a*) and (*b*) are a perspective view of a plan view showing a portion of the device according to the first embodiment.
Figure 2:
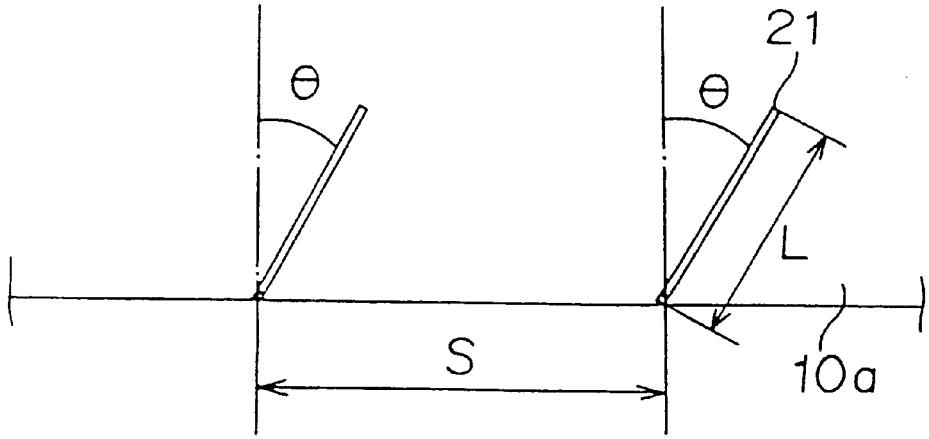

In FIGS. 1(*a*) and (*b*), and FIGS. 2(*a*) and (*b*), there are shown a front view of the device for controlling diffused air according to a first embodiment of the present invention, a vertical cross-sectional view of the device, a perspective view of a portion of the device, and a plan view of a portion of the device. There is shown an indoor unit of an air conditioning and heating device, which is constituted by a heat exchanger 1, a fan 2 and an air outlet 10. Reference numeral 10*a* designates an upper nozzle surface or an upper inner wall of an air outlet structure which provides the air outlet 10. Reference numeral 10*b* designates a lower nozzle surface or a lower inner wall of the air outlet structure. Reference numeral 11 designates diffused air. Reference numeral 12 designates a first flap which is arranged in the air outlet structure to guide the diffused air 11 in a vertical direction. Reference numeral 13 designates a plurality of second flaps which are arranged side by side in the air outlet structure to guide the diffused air in a horizontal direction. On a portion of the first flap 12 on a downstream side of the diffused air 11 are arranged a plurality of three-dimensional structures (vertical vortex generating structures) 21 which are constituted by triangular or a right triangular plate. The three-dimensional structures have respective bases contacted with the first flap 12. As shown in FIGS. 2(*a*) and (*b*), the three-dimensional structures 21 project perpendicularly from the first flap 12 into the diffused air 11, and the respective bases of the three-dimensional structures 21 which contact with the first flap 12 are oriented at an angle θ to a flow direction of the diffused air 11. In the first embodiment, the angle θ is 20 degree, and the three-dimensional structures 21 are arranged on the first flap at equal intervals. The three-dimensional structures 21 have a projection height h of 1/10 times a width W of the air outlet in a direction where the three-dimensional structures 21 project. The three-dimensional structures have a length L of 3 times the projection height h. The interval S between adjacent three-dimensional structures 21 is set to 5 times the length L.

Figure 3:
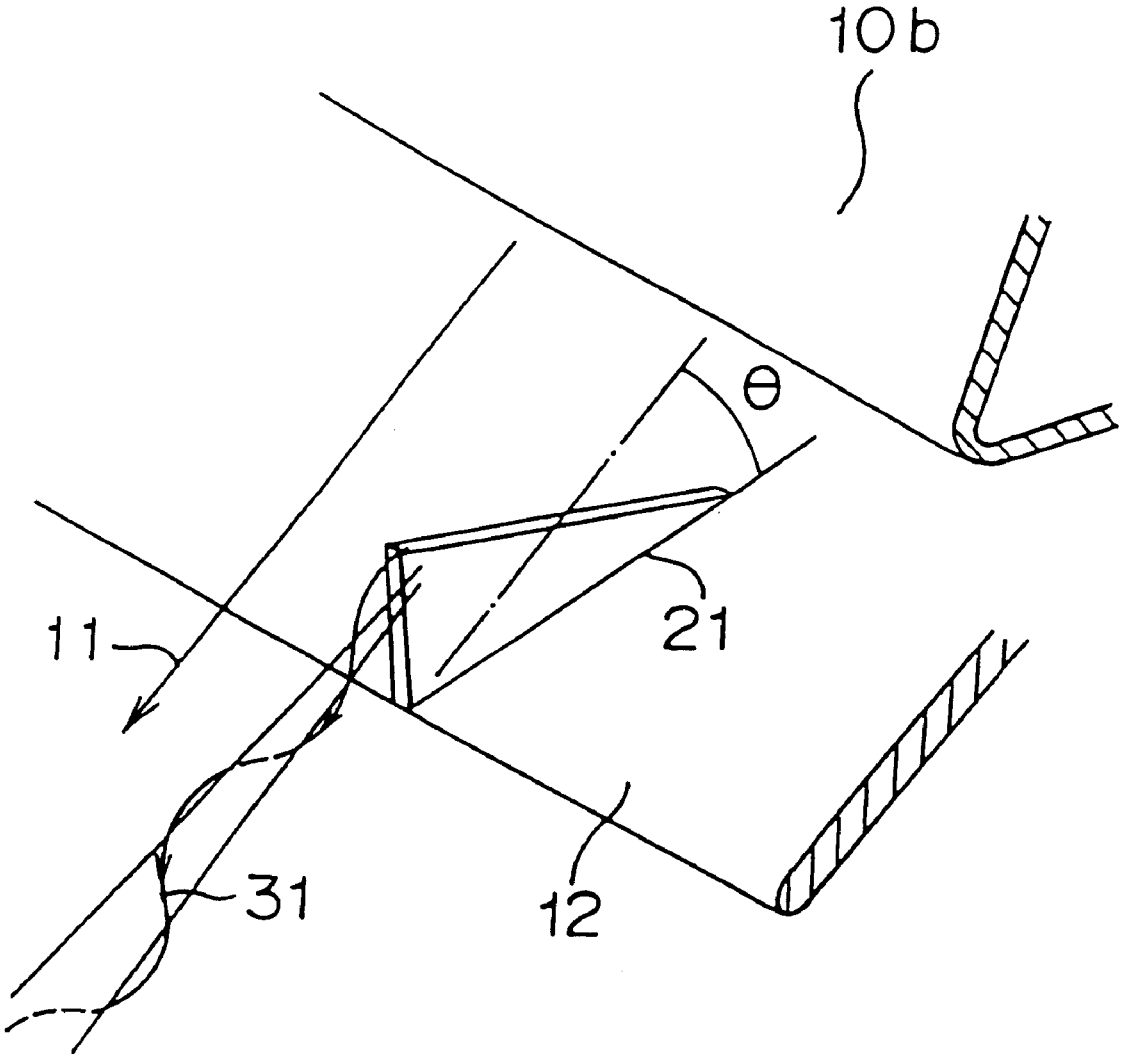
FIG. 3 is a perspective view of a portion of a three-dimensional structure in a triangular shape according to the first embodiment as viewed from downwardly.

In FIG. 3, there is shown a perspective view of a portion of a three-dimensional structure 21 arranged on the first flap 12 as viewed from downwardly, explaining the flow of the diffused air in the vicinity of the three-dimensional structure 21. When the diffused air passes the three-dimensional structure 21, a pressure difference is caused between a side of the structure against which the diffused air hits (a pressure surface) and the backside of the structure (a suction side). A flow, which is driven by the pressure difference to move onto the suction side from the pressure surface side beyond the hypotenuse of the right triangle generates a vertical vortex (a vortex having an axis oriented in the same direction as the diffused air) 31, and the vertical vortex 31 is extended and transferred in the downstream direction of the diffused air 11 by the inertial force of a primary flow of the diffused air. As explained, the three-dimensional structures 21 according to this embodiment works as the vertical vortex generating structure, and the three-dimensional structure having a function to generate a vertical vortex according to each of the following embodiments is also generally called a vertical vortex generating structure. In the warm diffused air 11, exchanging a part of a flow mass in the diffused air with a part of a flow mass in low temperature of ambient air is fostered at an interface between the diffused air and the ambient air by the vertical vortex 31 just after the diffused air has been blown out of the air outlet 10. As a result, the temperature of the diffused air 11 is lowered to minimize the temperature difference between the diffused air and the ambient air. The buoyance which is applied to the diffused air 11 upwardly in the vertical direction is reduced, offering an advantage in that the diffused air 11 can make a straight advance downwardly in the vertical direction in an effective way without the aid of a measure to increase the initial velocity of the diffused air. The warm diffused air can reach the floor in a room without rising, thereby to realize a room environment with little temperature difference in the vertical direction therein, improving comfort in the room in heating. This solution can improve comfort in a room having a relatively great space by setting the diffusing angle of the diffused air to a position near to the horizontal position in comparison with the conventional device because an adverse effect caused by the buoyance can be reduced.

Figure 4:
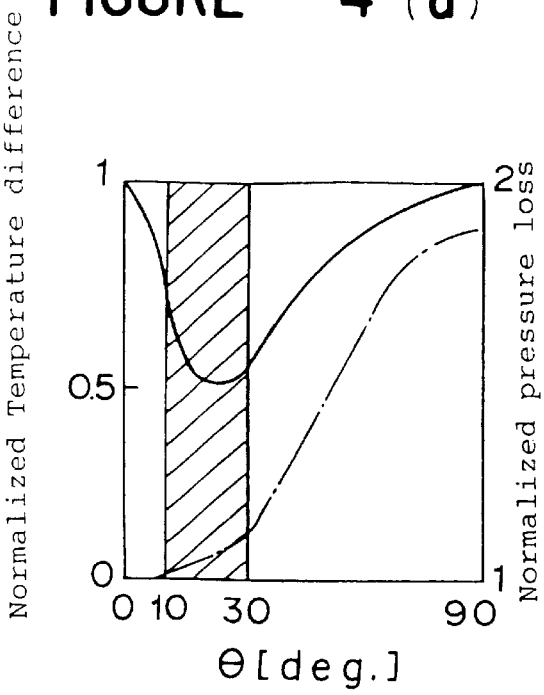
FIGS. 4(*a*)–(*d*) are diagrams to explain the dimensions of the three-dimensional structure according to the first embodiment.
Figure 4:
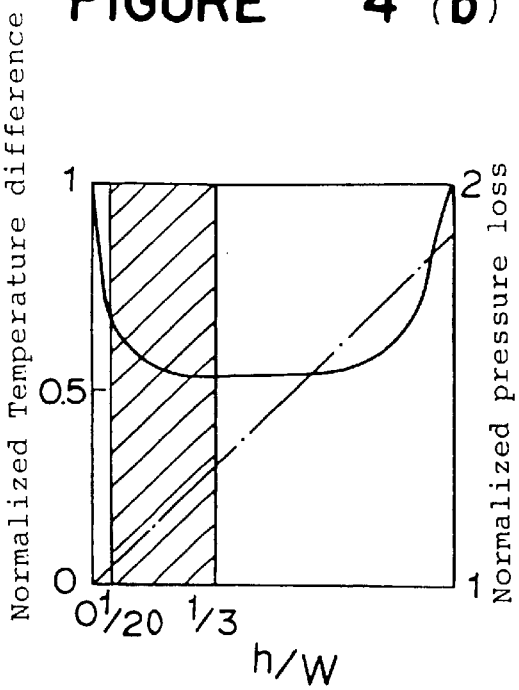
Figure 4:
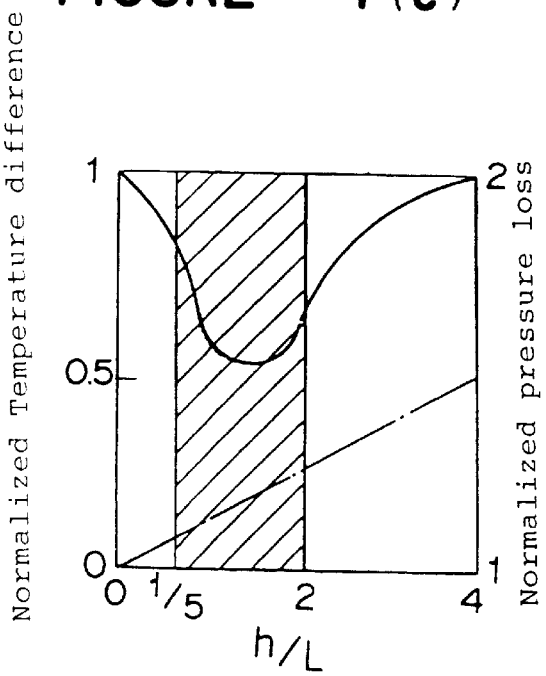
Figure 4:
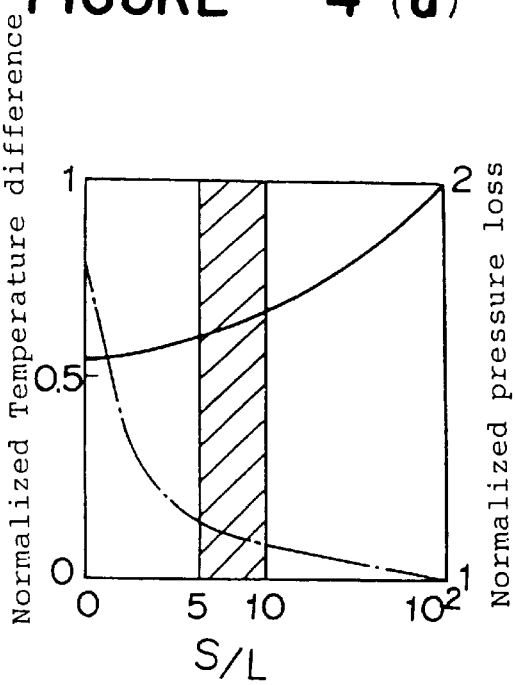

Although the dimensions of the vertical vortex generating structure 21 are set as explained in this embodiment, the conditions under which the three-dimensional structure formed in a plate shape can effectively work as the vertical vortex generating structure are $\theta$=10 degree–30 degree, h/W=1/20–1/3, h/L=1/5–2, and S/L=5–10. The explemental results which found the conditions are shown in FIGS. 4(*a*)–(*d*). The abscissa in FIG. 4(*a*) represents the angle $\theta$ of the base of a triangle to the diffused air. The left ordinate in this Figure represents a Normalized Temperature difference. The Normalized Temperature difference is found in such a way that a temperature difference between the center of diffused air and ambient air at a position 1 m apart from an air outlet with a vertical vortex generating structure along a track of the diffused air is found, and the temperature difference is divided by a temperature difference between the center of diffused air and ambient air at the same position from an air outlet without a vertical vortex generating structure. It is preferable that the Normalized Temperature difference is small because the mixture can be fostered in such a case to bring the temperature of the diffused air near to the temperature of the ambient air, minimizing an adverse effect due to buoyance. The results which were obtained by finding the Normalized Temperature difference with respect to the angle $\theta$ are indicated in a slid line. The right ordinate in this Figure represents Normalized pressure loss which was obtained by dividing the pressure loss in the provision of a vertical vortex generating structure by the pressure loss in the absence of a vertical vortex generating structure. An increase in pressure loss is not preferable because fan power is increased. The results which were obtained by finding the Normalized pressure loss with respect to the angle $\theta$ is indicated in a chain line. According to FIG. 4(*a*), the minimum value of the Normalized Temperature difference is an angle of 20 degree, and the pressure loss is increased as the angle becomes greater. This Figure clearly shows that the vertical vortex generating structure is set in a range of $\theta$=10 degree–30 degree. In FIG. 4(*b*), a change in the Normalized Temperature difference and a change in the Normalized pressure loss with respect to the dimensionless height h/W of vertical vortex generating structures are shown graphically. The solid line indicates the Normalized Temperature difference, and the chain line indicates the Normalized pressure loss. This Figure shows that the Normalized Temperature difference is almost constant except for the cases of h/W≈1 and h/W≈0 wherein the Normalized Temperature difference is near to 1 though the pressure loss increases in proportion to h/W. This figure shows that it is preferable to meet the requirements of h/W=1/20–1/3 wherein the pressure loss is small. In FIG. 4(*c*) is graphically shown a change in the Normalized Temperature difference and a change in the Normalized pressure loss with respect to standardized h/L which is obtained by dividing the height h of a vertical vortex generating structure by the length L of the base of the triangle. The solid line indicates the Normalized Temperature difference, and the chain line indicates the Normalized pressure loss. This Figure shows that the Normalized Temperature difference has the minimum value and that the Normalized pressure loss increases in proportion to an increase in h/L, which means that the optimum value is h/L=1/5–2. In FIG. 4(*d*) is graphically shown a change in the Normalized Temperature difference and a change in the Normalized pressure loss with respect to standardized S/L which is obtained by the interval S of adjacent vertical vortex generating structures by the length L of the base of the triangle. The solid line indicates the Normalized Temperature difference, and the chain line indicates the Normalized pressure loss. This Figure shows that the Normalized Temperature difference becomes greater as S/L becomes greater and that the Normalized pressure loss decreases as S/L increases, which means that the optimum value is S/L=5–10.

Although the vertical vortex generating structures are arranged on the portion of the first flap on the downstream side of the diffused air in this embodiment, the vertical vortex generating structures may be arranged on a portion of the first flap nearer to an upstream end than the downstream end, offering similar advantages. Although the vertical vortex generating structures 21 are prepared independently from the first flap and are coupled to the first flap in this embodiment, the vertical vortex generating structures may be prepared as integral parts of the first flap, offering similar effects.

Although the vertical vortex generating structures 21 have a leading edge formed in a sharp apex in this embodiment, the vertical vortex generating structures may have the leading edge rounded as a safety measure, offering similar advantages.

Figure 5:
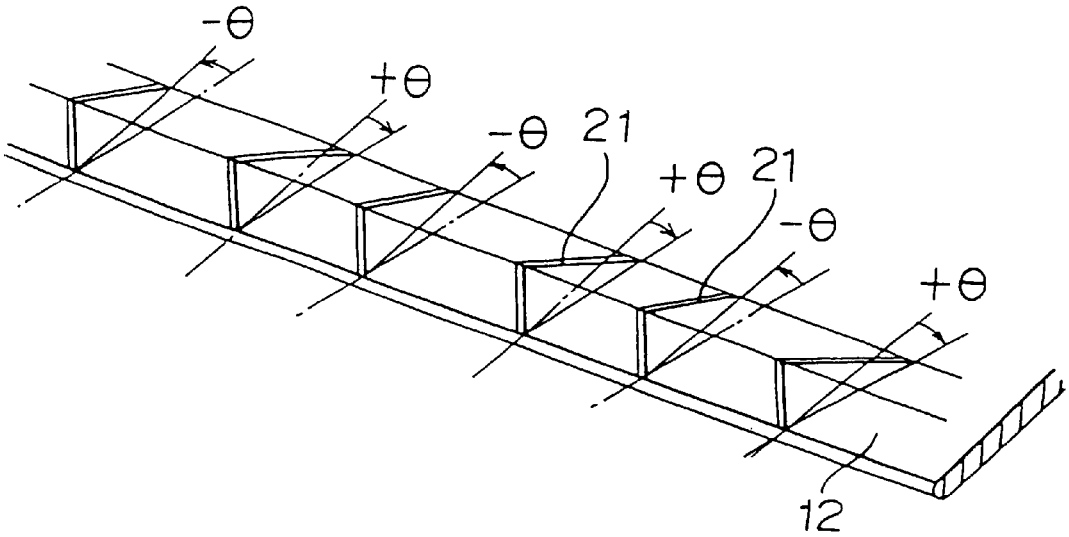
FIGS. 5(*a*)–(*c*) are diagrams to explain the three-dimensional structure arrangement according to the first embodiment.
Figure 5:
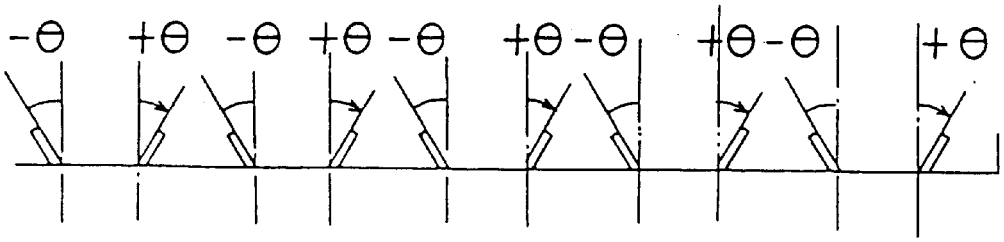
Figure 5:
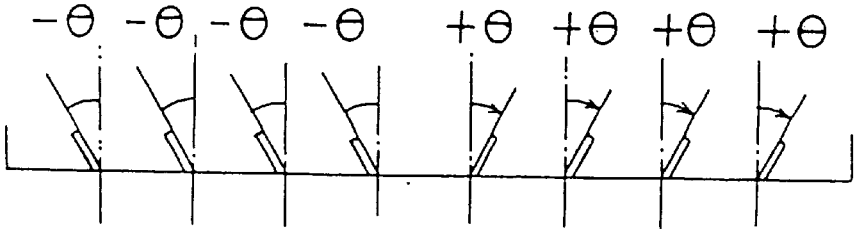

In the arrangement of the plural vertical vortex generating structures 21, all vertical vortex generating structures are not required to have the same angle $\theta$ with the diffused air. For example, adjacent vertical vortex generating structures 21 may be arranged on the first flap 12 so as to be convergent in such a manner that one is oriented at the angle θ clockwise (+θ) with respect to the flow direction of the diffused air 11 and the other is oriented at the angle θ counterclockwise (−θ) with respect to the flow direction of the diffused air as shown in FIGS. 5(*a*) and (*b*). Such arrangement also allows vertical vortexes generated by the vertical vortex generating structures 21 to exchange flow masses between the diffused air and the ambient air so as to lower the temperature of the diffused air, thereby reducing the influence by buoyancy and contributing to the straight advance of the diffused air downwardly in the vertical direction. When a pair of adjacent vertical vortex generating structures are convergently arranged as shown, the rotational direction of the vertical vortex generated by a vertical vortex generating structure is opposite to that of the vertical vortex generated by a adjacent vertical vortex generating structure to prevent exchanging of flow masses between the ambient air and the diffused air from being made only in the clockwise direction or the counterclockwise direction, offering an advantage in that the supplied air is stabilized. FIG. 5(*b*) is a view of the arrangement of FIG. 5(*a*) as viewed from upwardly. As another example, the vertical vortex generating structures which are arranged in a right half portion of the air outlet are oriented at the angle θ clockwise (+θ) and the vertical vortex generating structures which are arranged in a left half portion of the air outlet are oriented at the angle θ counterclockwise (−θ) so as to be symmetrical with the vertical vortex generating structures in the right half portion with respect to the center of the air outlet in the longitudinal direction as shown in FIG. 5(*c*). The diffused air is stabilized as a whole in this case as well.

Embodiment 2

Figure 6:
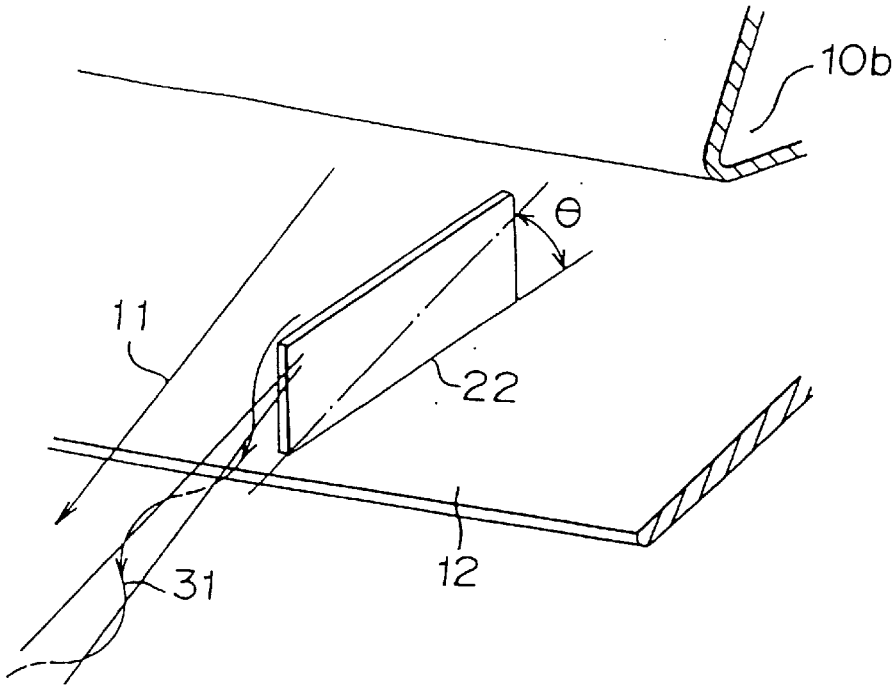
FIG. 6 is a perspective view of the three-dimensional structure in a rectangular shape according to a second aspect of the present invention as viewed from downwardly.

In FIG. 6 is shown a perspective view of a portion of a second embodiment of the present invention as viewed from downwardly. In this embodiment, the plural vertical vortex generating structures 22 on the first flap 12 are constituted by a rectangular plate, and set at the angle θ with respect to the flow direction of the diffused air 11 as in the first embodiment. This embodiment also offers advantages in that vertical vortexes are generated to mix the diffused air with ambient air having a lower temperature so as to lower the temperature of the diffused air, reducing the buoyancy applied on the diffused air as in the first embodiment.

Embodiment 3

Figure 7:
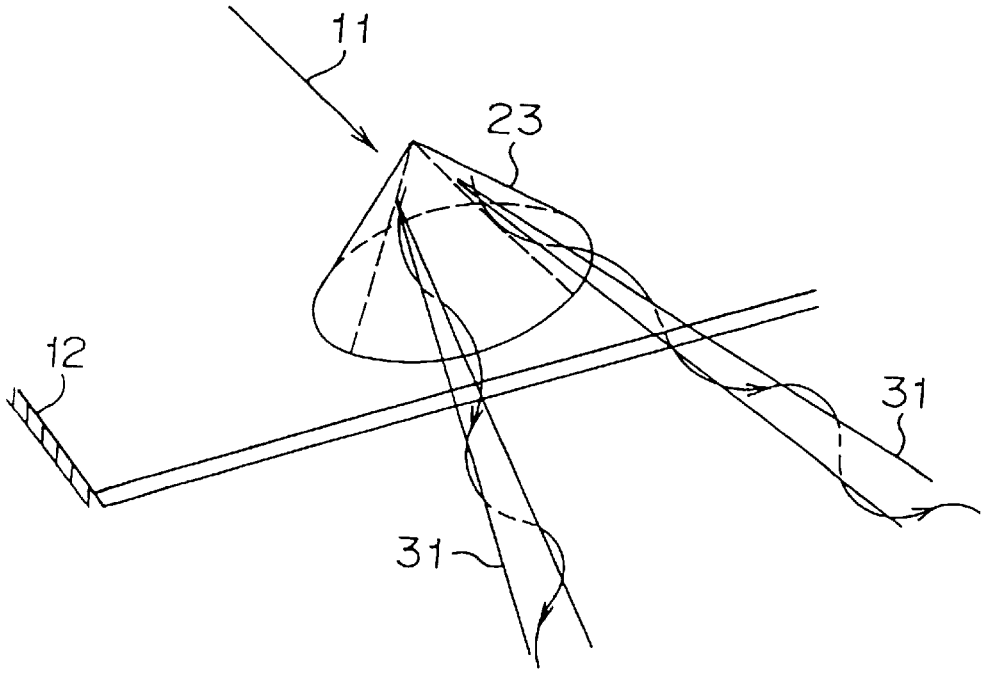
FIG. 7 is a perspective view of the three-dimensional structure in a circular cone shape according to a third embodiment of the present invention.

In FIG. 7 is shown a perspective view of a portion of a third embodiment of the present invention. The plural vertical vortex generating structures 23 on the first flap 12 are formed in a circular cone shape so that the base of the cone of each vertical vortex generating structure joins to the first flap. This embodiment also generates vertical vortexes in the vicinity of generating lines of each cone which are located at sides of an imaginary triangle obtained by projecting the cone toward the flow direction of the diffused air, as in the first embodiment. The generated vertical vortexes mix the diffused air with ambient air having a lower temperature to lower the temperature of the diffused air, offering an advantage in that the buoyancy applied to the diffused air decreases. This embodiment offers an advantage in that structural strength is enhanced in comparison with the plate shaped vertical vortex generating structures 21 and 22 according to the first and second embodiments. Although the vertical vortex generating structures 23 are jointed to the first flap in this embodiment, the vertical vortex generating structures may be prepared as integral parts of the first flap, offering similar advantages.

Although the vertical vortex generating structure 23 are shown to be formed in a circular cone shape in this embodiment, the vertical vortex generating structures may be formed in an elliptical cone shape, offering similar advantages.

Embodiment 4

Figure 8:
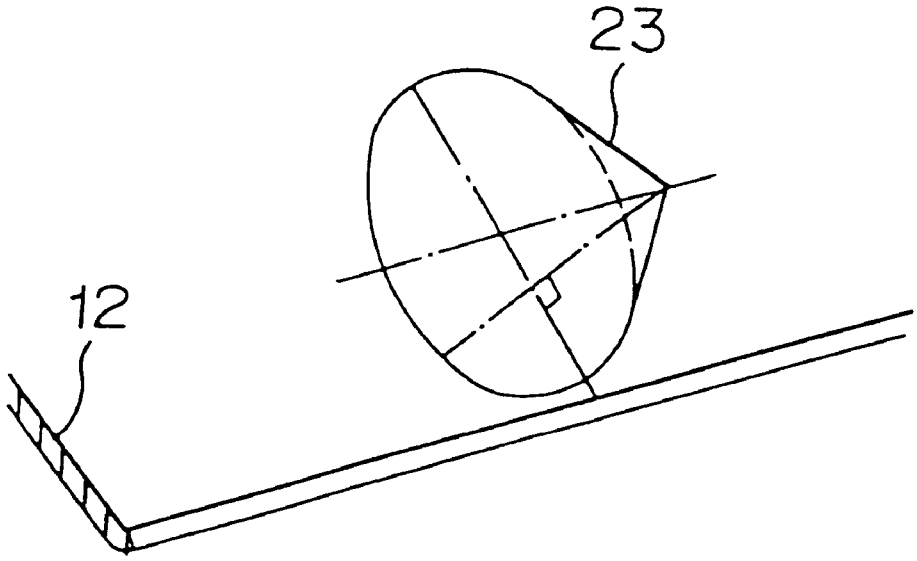
FIGS. 8(*a*) and (*b*) are perspective views of an example and another example of the three-dimensional structure according to a fourth embodiment of the present invention.
Figure 8:
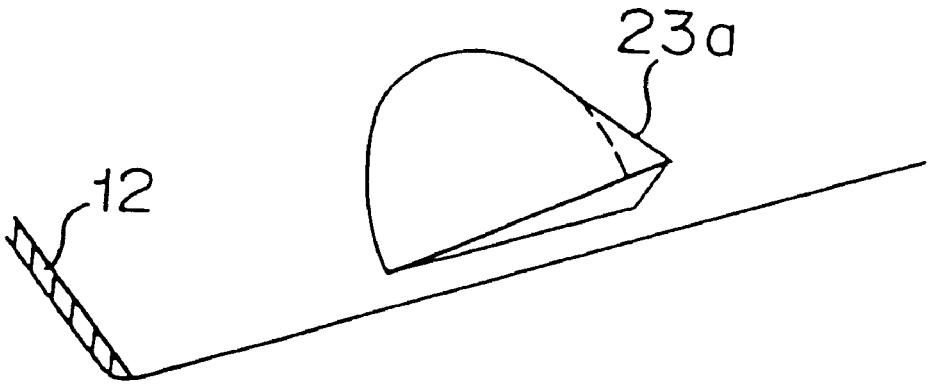

In FIGS. 8(*a*) and (*b*) are shown perspective views of a fourth embodiment of the present invention. In the example shown in FIG. 8(*a*), a vertical vortex generating structure 23 in a circular cone shape has an apex which projects into the diffused air 11 and which is located on a downstream side of the diffused air with respect to an axis extending perpendicularly to a center of the bottom surface of the cone. Although vertical vortexes are generated in the vicinity of generating lines of the cone which are located at sides of an imaginary triangle obtained by projecting the cone toward the flow direction of the diffused air in this embodiment as well, the pressure on a portion of the cone surface in a downstream side is further lowered because the apex of the cone is located on the downstream side of the diffused air 11 and the gradient of that portion is great. Stronger vertical vortexes are generated to quicken the mixture in comparison with the third embodiment, offering an advantage in that the diffused air is mixed with ambient air having a lower temperature to lower the temperature of the diffused air, decreasing the buoyancy applied to the diffused air. The warm air can reach the floor in the room without rising, improving comfort in the room. Although the vertical vortex generating structure 23 is jointed to the first flap in this embodiment, the vertical vortex generating structure may be prepared as an integral part of the first flap, offering similar advantages.

Since the vertical vortexes are generated in the vicinities of the generating lines of the cone which are located on the sides of the projected imaginary isosceles triangle as viewed toward the flow direction, a portion of the cone which is located downstream the generating lines is not required for generating the vertical vortexes. The provision of a vertical vortex generating structure 23*a* which is formed in a semicircular cone shape obtained by cutting the portion downstream the generating lines as shown in FIG. 8(*b*) can produce a much lower pressure to generate much stronger vertical vortexes.

Embodiment 5

Figure 9:
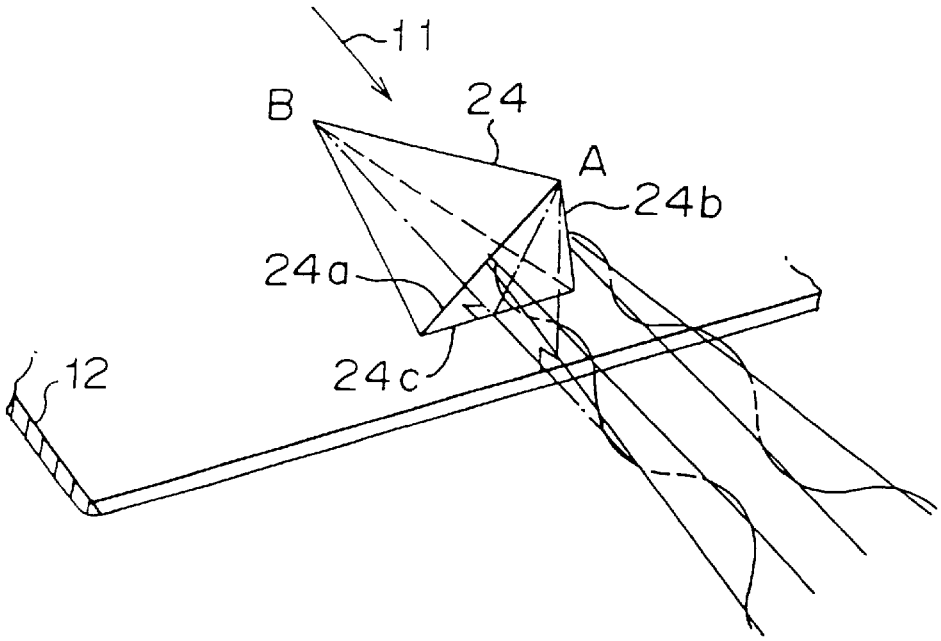
FIG. 9 is a perspective view of the three-dimensional structure in a triangular pyramid shape according to a fifth embodiment of the present invention.

In FIG. 9 is shown a perspective view of a fifth embodiment of the present invention. A plurality of vertical vortex generating structures 24 on the first flap 12 are formed in a triangular pyramid shape. A side 24*c* of the triangle which is located as a bottom surface of each vertical vortex generating structure contacting with the first flap 12 is oriented substantially perpendicular to the flow direction of the diffused air 11. Each vertical vortex generating structure is arranged so as to have the side 24*c* located on a downstream side of the diffused air 11 with respect to the other sides. In this embodiment, each triangular pyramid has an apex A projected into the diffused air so as that a point of intersection between a perpendicular extending from the apex to the first flap 12 and the flap 12 is located outside the triangle as the bottom surface and on the downstream side of the diffused air 11 with respect to the side 24*c* of the triangle. Such arrangement and shape can generate vertical vortexes at sides 24*a* and 24*b* of each triangular pyramid on the downstream side as shown in FIG. 9. In this embodiment, the triangular surface having the sides 24*a*, 24*b* and 24*c* as three sides is slanted toward the downstream direction of the diffused air with respect to the first flap 12. A drop in the pressure caused on the triangular surface becomes greater to generate stronger vertical vortexes, quickening the mixture. As a result, the advantage in that the diffused air is mixed with ambient air having a lower temperature to lower the temperature of the diffused air so as to reduce the buoyancy applied to the diffused air is further improved. This embodiment can offer an advantage in that structural strength is enhanced in comparison with the plate shaped vertical vortex generating structures 21 and 22 according to the first and second embodiments. This embodiment can offer an advantage in that flow resistance to the diffused air is minimized to provide a vertical vortex generating structure having lower pressure loss in comparison with the first through fourth embodiments because each vertical vortex generating structure 24 has an upstream edge B pointed. Although the vertical vortex generating structure 24 are jointed to the first flap in this embodiment, the vertical vortex generating structures may be prepared as integral parts of the first flap, offering similar advantages.

Embodiment 6

Figure 10:
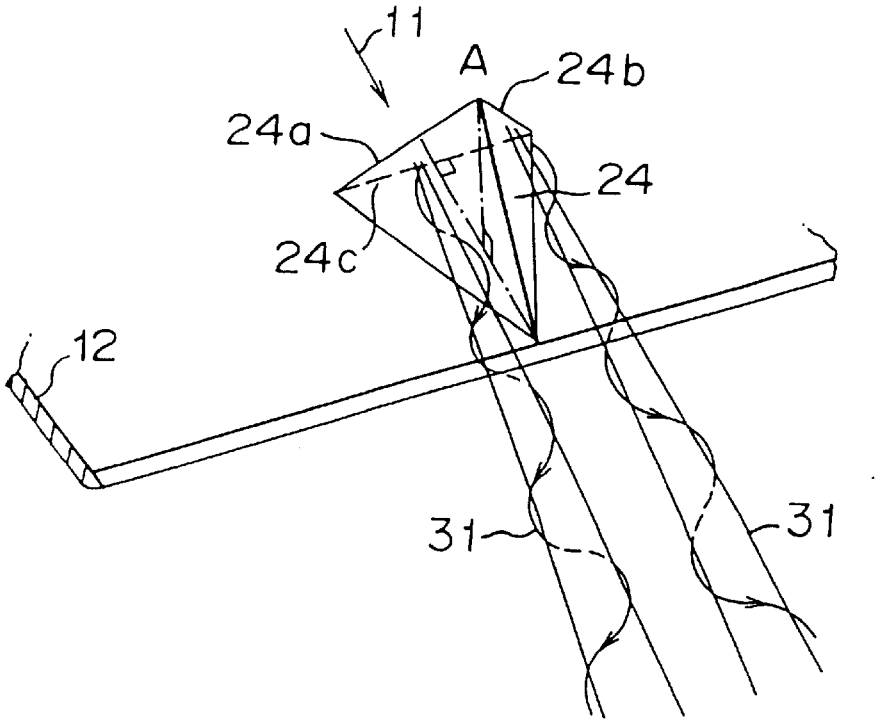
FIG. 10 is a perspective view of the three-dimensional structure in a triangular pyramid shape according to a sixth embodiment of the present invention.

In FIG. 10 is shown a perspective view of a sixth embodiment of the present invention. The plural vertical vortex generating structures 24 on the first flap 12 are formed in a triangular pyramid shape. A side 24*c* of the triangle which is located as a bottom surface of each vertical vortex generating structure 24 contacting with the first flap 12 is oriented substantially perpendicular to the flow direction of the diffused air 11. In addition, each vertical vortex generating structure 24 is arranged so as to have the side 24*c* located on an upstream side of the diffused air 11 with respect to the other two sides. In this embodiment, each triangular pyramid has an apex projected into the diffused air so that a point of intersection between a perpendicular extending from the apexes to the first flap 12 is located on a downstream side of the diffused air with respect to the side 24*c*. Such arrangement and shape can generate the vertical vortex at sides 24*a* and 24*b* of the triangular surface opposed to the diffused air 11 on the upstream side as shown in FIG. 10. In this embodiment, the triangular surface having the sides 24*a*, 24*b* and 24*c* as three sides is slanted toward the downstream direction of the diffused air, and the diffused air equally flows on the slanted triangular surface to make the sides 24*a* and 24*b* contributed to generation of the vertical vortexes along their entire strength, generating the vertical vortexes in a strong way as in the first embodiment. In addition, each vertical vortex generating structure is formed in a polygonal pyramid shape, offering sufficient strength. Although the vertical vortex generating structures are jointed to the first flap in this embodiment, the vertical vortex generating structures may be prepared as integral parts of the first flap, offering similar advantage.

Although the vertical vortex generating structure 23 are formed in a triangular pyramid shape in the fifth and sixth embodiments, the vertical vortex generating structures may be formed in another polygonal pyramid shape such as a quadrilateral pyramid shape, offering similar advantages.

Embodiment 7

Figure 11:
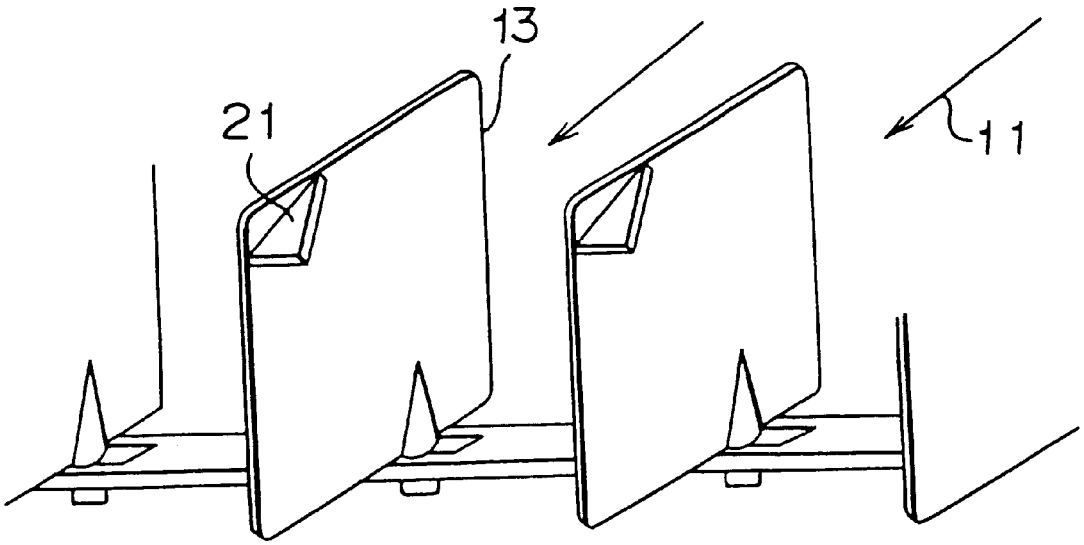
FIG. 11 is a perspective view of the flap according to a seventh embodiment of the present invention.

In FIG. 11 is shown a perspective view of a seventh embodiment of the present invention. In this embodiment, the vertical vortex generating structures 21 in a triangular shape which are referred to with respect to the first embodiment are arranged on an upper portion of a leading edge of each of second flaps 13 on the downstream side of the diffused air. The second flaps are arranged side by side in the air outlet to guide the diffused air in a horizontal direction. According to this embodiment, even if the diffused air is deflected in the horizontal direction by the second flaps 13, the vertical vortex generating structures 21 can work effectively.

Although the vertical vortex generating structures 21 are arranged on the upper portion of each of the second flaps 13 in this embodiment, the vertical vortex generating structures may be arranged on a lower portion of the leading edge.

Although the vertical vortex generating structures 21 are shown to be formed in a right triangular shape, the vertical vortex generating structures on the second flaps may be formed as the rectangular shape of vertical vortex generating structures 22, the circular cone shape of vertical vortex generating structures 23 and the triangular pyramid shape of vertical vortex generating structures 24 shown with respect to the second through sixth embodiments, offering similar advantages. Although the vertical vortex generating structures are jointed to the second flaps in this embodiment, the vertical vortex generating structures may be prepared as integral parts of the second flaps, offering similar advantages.

Embodiment 8

Figure 12:
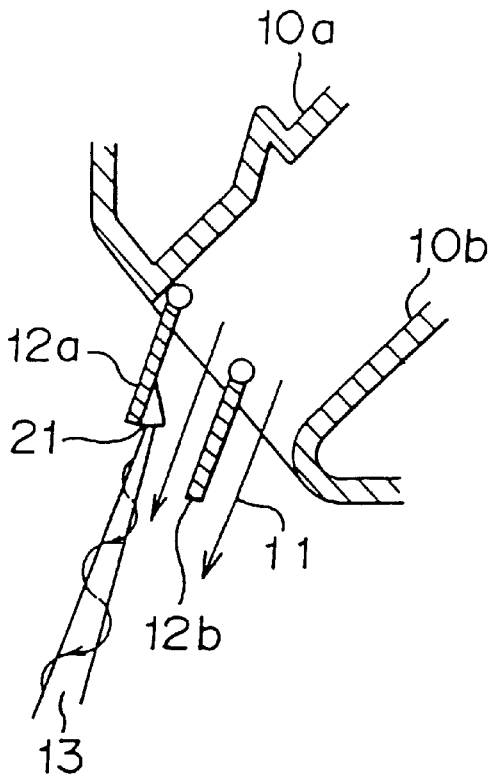
FIGS. 12(*a*) and (*b*) are vertical sectional views of the air outlet according to an eighth embodiment of the present invention.
Figure 12:
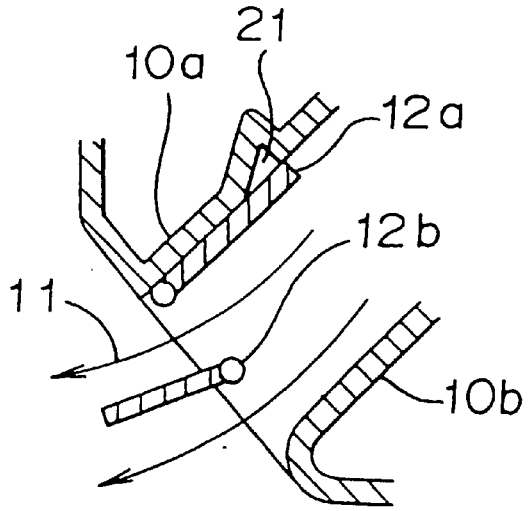

In FIGS. 12(*a*) and (*b*) are shown vertical cross-sectional views of the air outlet according to an eighth embodiment of the present invention. In this embodiment, a pair of first flaps 12 are arranged in the air outlet to control the flow direction of the diffused air 11 in the vertical direction, and the vertical vortex generating structures 21 are formed on a downstream side on a lower surface of the upper flap 12*a* so that the bottom surface of each of the vertical vortex generating structures is jointed to the lower side of the upper second flap. In FIG. 12(*a*) are shown the positions of the flaps in heating, wherein the flaps 12*a* and 12*b* are set to be oriented downwardly so as to deflect the diffused air 11 downwardly. In this case, the vertical vortexes 31 are generated when the diffused air 11 is passing the vertical vortex generating structures 21 on the upper flap 12*a*. The diffused air can mix with ambient air having a lower temperature. On the other hand, in FIG. 12(*b*) are shown the positions of the flaps in cooling or ventilating, wherein the upper flap 12*a* with the vertical vortex generating structures arranged thereon is accommodated into an upper surface 10*a* of the air outlet 10, and the diffused air 11 is deflected substantially in the horizontal direction by the lower flap 12*b*. According to this embodiment, the vertical vortex generating structures 21 are moved into the diffused air to prevent the diffused air from rising in heating as shown in FIG. 12(*a*) while the vertical vortex generating structures 21 which are a bar to flow out a jet with turbulence minimized are withdrawn from the diffused air 11 so as to work efficiently in heating, cooling and ventilating modes as shown in FIG. 12(*b*). In cooling and ventilating, the diffused air is not raised by buoyancy and there is no need for mixing the diffused air with ambient air. In addition, the upper flap 12*a* is moved as shown in FIG. 12(*b*), avoiding a case wherein humid and hot ambient air is involved in cooling to dew an upper surface of the upper flap 12*a*.

Embodiment 9

Figure 13:
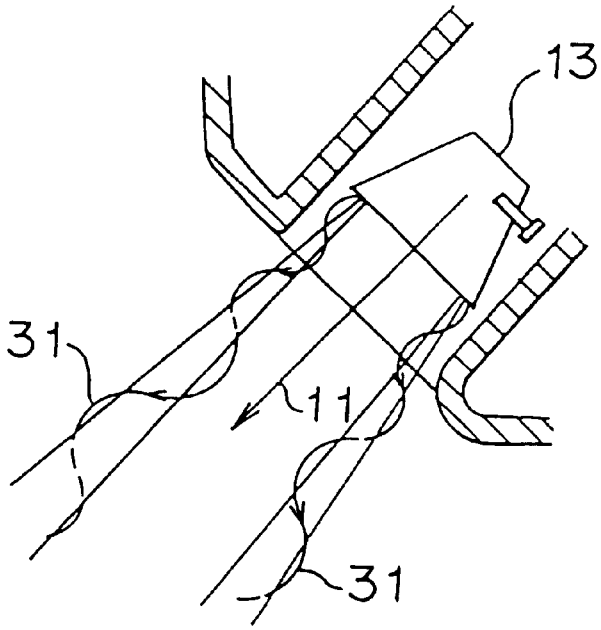
FIGS. 13(*a*) and (*b*) are a vertical cross-sectional view and a diagram to show the structure and the operation of the flap according to a ninth embodiment of the present invention.
Figure 13:
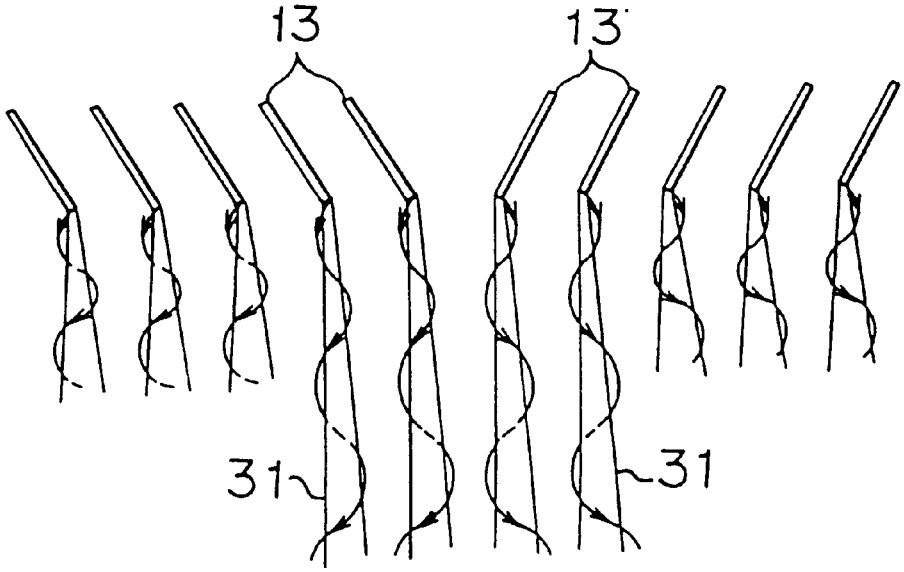
Figure 14:
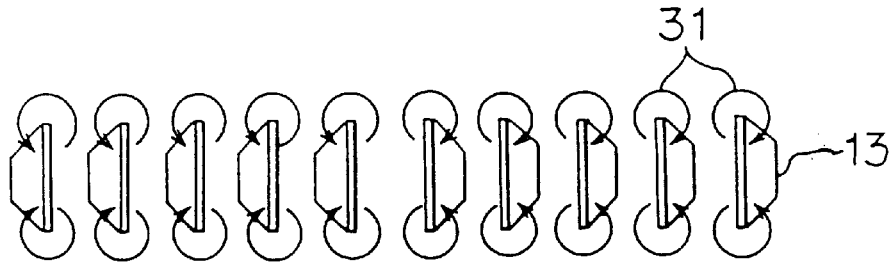
FIGS. 14(*a*) and (*b*) are diagrams to show the operation of the flap according to the ninth embodiment.
Figure 14:
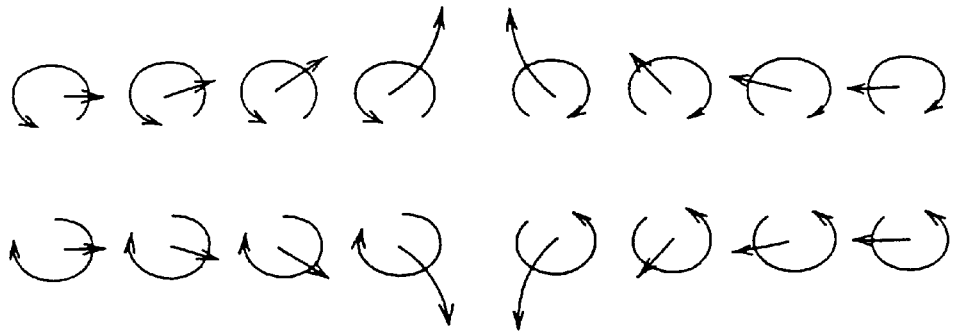

In FIGS. 13(*a*)–(*b*) is shown a ninth embodiment. In FIG. 13(*a*) is shown a vertical cross-sectional view of the air outlet of this embodiment. The plural second is flaps 13 which are arranged in the air outlet 10 are formed in such a trapeziform shape that each of the second flaps has two sides extending perpendicular to the flow direction of the diffused air 11 and that one of the sides on the downstream side of the diffused air is longer than the other side on the upstream side of the diffused air so as to have a vertical length gradually increased from the upstream side toward the downstream side of the diffused air. In FIG. 13(*b*) is shown a view of the plural second flaps 13 as viewed from upwardly. The plural second flaps 13 are arranged so that a group of the flaps in a left half and a group of the flaps in a right half are respectively oriented toward a central portion of the air outlet in a longitudinal direction of the air outlet. Although the hot diffused air 11 is forwardly blown out of the air outlet 11 as a whole, a pair of vertical vortexes 31 are generated at the upper and lower portions of the downstream edge of each of the second flaps 13 to involve ambient air having a lower temperature so as to lower the temperature of the diffused air when the diffused air is passing the flaps 13. As a result, advantages similar to the respective embodiments can be offered. In addition, according to this embodiment, the vertical vortexes are generated so that the vortexes are directed clockwise at the upper portion of the second flaps 13 in the right group, the vortexes are directed counterclockwise at the upper portion of the second flaps in the left group, the vortexes are directed counterclockwise at the lower portion of the second flaps 13 in the right group, and the vortexes are directed clockwise at the lower portion of the second flaps in the left group, as schematically shown in FIGS. 13(*b*) and 14(*a*). This is because the respective second flaps 13 are oriented toward the center of the air outlet as stated earlier. As shown in FIG. 14(*b*), the vortexes generated at the upper portions of the second flaps move upwardly and the vortexes generated at the lower portions of the second flaps move downwardly while the vortexes move toward the center of the air outlet being directed downstream as a whole because of the presence of their own inherent movement. These movements of the vertical vortexes cause the diffused air 11 to converge in the center so as to be modified from a wide jet into almost an axisymmetric jet. As a result, the contacting surface of the diffused air 11 with ambient air decreases to restrain the velocity of the diffused air from being damped, offering an advantage in that the diffused air can become an air flow to improve a straight advance so as to reach a portion in the room further from the air conditioning and heating device.

Embodiment 10

Figure 15:
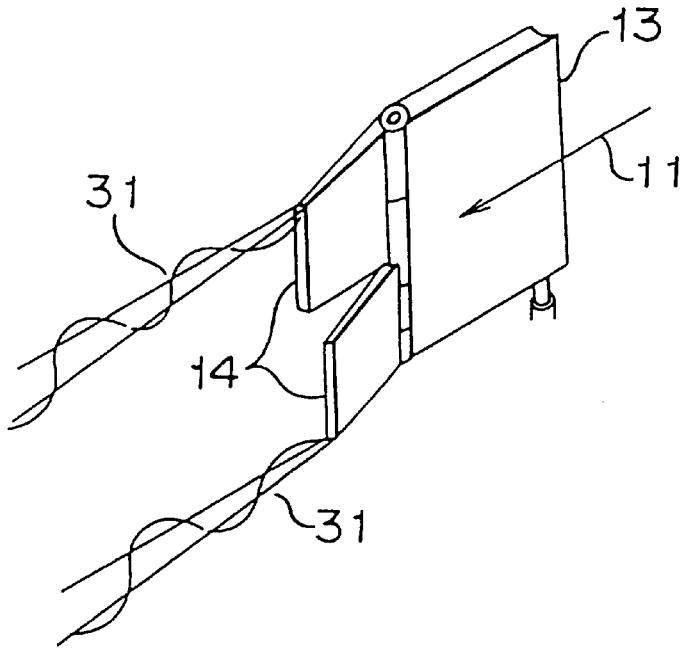
FIG. 15 is a perspective view of the flap according to a tenth embodiment of the present invention.
Figure 16:
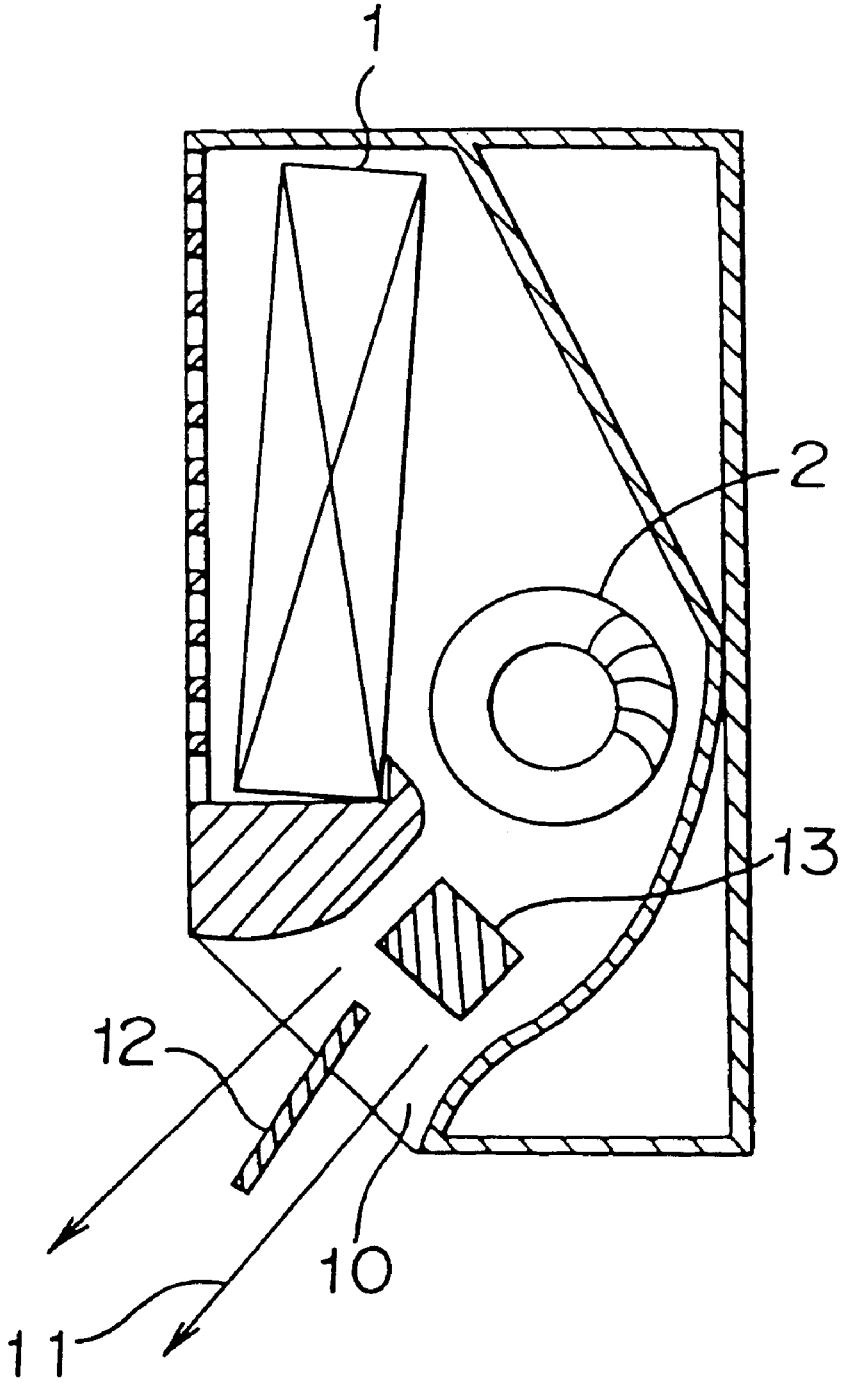
FIGURE 16 PRIOR ART
FIG. 16 is a vertical cross-sectional view showing the indoor unit of a conventional air conditioning and heating device.

In FIG. 15 is shown a perspective view of a second flap according to a tenth embodiment. In this embodiment, the strength of the vertical vortex generated at the upper edge portion of each second flap 13 and the strength of the vertical vortex generated at the lower edge portion of each second flap are independently controlled to change the direction of the diffused air in a jet form at a position far from the air outlet. As shown in FIG. 15, the downstream side of each of the second flaps 13 is divided into upper and lower guide wings 14. The respective guide wings 14 are provided with driving means for driving the guide wings independently of each other. The angles of attack of the respective guide wings 14 with respect to the diffused air flowing along each of the second flaps 13 are controlled by the driving means to change the strength of the vertical vortexes generated at the downstream edge of the guide wings 14. For example, when the angle of attack of the lower guide wing increases while the angle of attack of the upper guide wing decreases, the strength of the vertical vortex generated at the lower edge can be made larger than the strength of the vertical vortex generated at the upper edge. As a result, with regard to the vertical vortexes in the vicinity of the center of the air outlet, the vertical vortexes generated at the lower edge portions have a greater transfer velocity in a downward direction, offering an advantage in that the diffused air can be downwardly defected at a position far from the air outlet.

What is claimed is:

1. A device for controlling diffused air, comprising:

an air outlet structure connected to a terminal end of an air path so as to diffuse air into ambient air;

a flap arranged in the air outlet structure for deflecting a flow direction of the diffused air; and ambient air drawing and mixing means for drawing the ambient air into the diffused air and mixing the ambient air with the diffused air, wherein the ambient air drawing and mixing means is arranged in the air outlet structure so as to project into the diffused air and is constituted by at least one three-dimensional structure for generating a vertical vortex in the diffused air, and the three dimensional structure is configured so as to be prevented from interfering with the diffused air when the diffused air has a temperature not higher than the ambient air.

2. The device according to claim 1, wherein the flap is arranged in the air outlet structure so as to guide the diffused air in a vertical direction, and the three dimensional structure is arranged on the flap.

* * * * *

UNITED STATES PATENT AND TRADEMARK OFFICE

CERTIFICATE OF CORRECTION

PATENT NO. : 6,276,440 B1
DATED : August 21, 2001
INVENTOR(S) : Kaga et al.

It is certified that error appears in the above-identified patent and that said Letters Patent is hereby corrected as shown below:

Title page,
Item [30], the Foreign Application Priority Data should be omitted.

Signed and Sealed this

Thirtieth Day of April, 2002

*Attest:*

*Attesting Officer*

JAMES E. ROGAN
*Director of the United States Patent and Trademark Office*